US006375024B1

(12) United States Patent
Park

(10) Patent No.: US 6,375,024 B1
(45) Date of Patent: Apr. 23, 2002

(54) VACUUM APPARATUS FOR FORMING A VACUUM IN A CONTAINER

(76) Inventor: Yoon Sik Park, 7-102 Jukong Apartment, 249-18 Kuseo-Dong, Kuemjeong-Ku, Pusan (KR)

( * ) Notice: Subject to any disclaimer, the term of this patent is extended or adjusted under 35 U.S.C. 154(b) by 0 days.

(21) Appl. No.: 09/377,643

(22) Filed: Aug. 19, 1999

(51) Int. Cl.[7] ..... B65D 51/16

(52) U.S. Cl. ..... 215/262; 215/315; 215/311; 215/260; 215/228; 220/212; 220/231; 220/203.04; 220/203.07; 220/203.23; 220/374; 220/240

(58) Field of Search ..... 215/228, 307, 215/262, 270, 260, 311, 315; 220/212, 203.04, 203.07, 203.23, 203.24, 203.28, 231, 240, 367.1, 374

(56) References Cited

U.S. PATENT DOCUMENTS 4,703,865 A * 11/1987 Bates ..... 215/307
4,763,802 A * 8/1988 Johnston ..... 215/225
5,031,785 A * 7/1991 Lemme ..... 215/228
5,207,339 A * 5/1993 Shyu ..... 215/228
5,392,967 A * 2/1995 Satomi et al. ..... 215/305 X
5,405,038 A * 4/1995 Chuang ..... 215/228 X
5,406,992 A * 4/1995 Miramon ..... 215/228 X
5,449,079 A * 9/1995 Yang ..... 215/228
5,499,735 A * 3/1996 Chen ..... 220/212 X
5,546,997 A * 8/1996 Miromon ..... 215/228 X
5,558,243 A * 9/1996 Chu ..... 215/228 X
5,564,480 A * 10/1996 Chen ..... 215/228 X
5,651,470 A * 7/1997 Wu ..... 220/212
5,692,632 A * 12/1997 Hsieh et al. ..... 215/228 X
5,735,317 A * 4/1998 Wu ..... 215/228 X
5,803,282 A * 9/1998 Chen et al. ..... 215/228
5,850,908 A * 12/1998 Jasek ..... 220/212 X
5,944,212 A * 8/1999 Chang ..... 220/212
5,957,317 A * 9/1999 Lee ..... 215/228 X
5,992,666 A * 11/1999 Wu ..... 215/228 X
6,044,756 A * 4/2000 Chang ..... 220/212 X

* cited by examiner

*Primary Examiner*—Allan N. Shoap
*Assistant Examiner*—Robin S Hylton
(74) *Attorney, Agent, or Firm*—Nixon Peabody LLP; Thomas W. Cole

(57) ABSTRACT

A vacuum apparatus for easily forming a vacuum in any bottle, container or the like and for providing a stable sealing. A lower cylindrical member together with a disc member forms a space portion in which a vacuum or an atmospheric pressure is applied, and the lower portion of an upper cylindrical member is inserted in the space portion and divides the space portion into upper and lower spaces. With a downward movement of the upper cylindrical member, the upper space expands and draws air inside of a bottle, and with an upward movement thereof, the air introduced into the upper space is vented outside. At this time, a check valve is selectively opened and closed and is operated by a pressure difference applied thereon. By repetitive reciprocating movement of the upper cylindrical member, a high vacuum is formed in the bottle and is sealed by the check valve. The apparatus is adaptable in a vacuum bottle, a medical suction instrument or the like.

12 Claims, 17 Drawing Sheets

PRIOR ART

PRIOR ART

PRIOR ART

VACUUM APPARATUS FOR FORMING A VACUUM IN A CONTAINER

BACKGROUND OF THE INVENTION

1. Field of the Invention

The present invention relates to a vacuum apparatus, and more particularly to a vacuum apparatus for easily forming a high vacuum in a bottle or the like.

2. Description of the Prior Art

In general, the usage of vacuum bottles or containers are wide spread from medical applications to storing foods or chemical solutions, and its need are just as diverse. For example, coffee beans which are sensitive to a moisture is usually stored in the vacuum bottle to maintain its freshness.

Various apparatuses and methods for forming and maintaining a vacuum in a bottle have been proposed. FIGS. 1 to 4 show a sealing cap disclosed in a U.S. Pat. No. 4,703,865. Referring to FIGS. 1 to 4, the sealing cap comprises a tubular body portion 10 with an encircling skirt 12 which grips a bottle or other like containers. Body portion 10 and skirt 12 are formed in one-piece from rubber or other elastomeric material. A through-bore 14 extending along the axial direction of body portion 10 receives a plug 30 of elastomeric material. Plug 30 is movable downward from the initial state shown in FIG. 1.

As shown in FIG. 2, as plug 30 moves downward, the air in the bottle flow out through through-bore 14, and as shown in FIG. 3, plug 30 moves to its final position so as to maintain the vacuum status in the bottle.

Through-bore 14 includes circular portions 15 and 16, and a tapered portion 17. In the initial state of FIG. 1, plug 30 is inserted into an annular groove 16 by a disk portion 33, and the body portion thereof is press-fitted against tapered portion 17.

Tapered portion 17 is formed at a lower portion thereof with a bore portion 18 having a cross-section as shown in FIG. 4. When plug 30 moves inside of bore portion 18, a clearance is formed between plug 30 and an inside wall of bore portion 18 so that the air in the bottle can flow outside through the cap. That is, bore portion 18 has a substantially triangular cross-section thereby forming the clearance with plug 30.

Bore portion 18 is formed at a lower portion thereof with an annular groove 19 and finally with a taper portion 20. When in the final state shown in FIG. 3, plug 30 is inserted into annular groove 19 by disk portion 33 and the body thereof is press-fitted against tapered portion 20.

Through the above described operations, sequentially shown in FIGS. 1 to 3, bottle 40 comes to be evacuated.

However, the sealing cap according to the conventional technique cannot achieve a high vacuum in the bottle because its one time operation which draws only a small amount of the air. In addition, the vertical movement of the plug is not efficient due to its structural inconvenience when manipulated by the user.

SUMMARY OF THE INVENTION

In view of the foregoing, it is an object of the present invention to provide a vacuum apparatus which forms a high vacuum in a predetermined space by repetitive push down operations and stably seals the vacuum state.

To achieve the object, a first embodiments of the present invention provides a vacuum apparatus comprising: a first means for forming a space portion in which a vacuum pressure or an ambient pressure is applied, the first means being assembled to a space member which encloses a predetermined space; a second means for forming vacuum or ambient state in the space portion, the second means being inserted a lower portion thereof into the first means and vertically reciprocating; a third means for connecting or closing a passage between the space member and the space portion responding to a movement of the second means; a fourth means for connecting or closing a passage between the space portion and ambient responding to the movement of the second means; and a fifth means for releasing a vacuum inside the space member.

The first means includes a lower cylindrical member with an upper portion thereof being opened and a first disc member assembled to the upper portion of the lower cylindrical member and defining an uppermost position of the second means, the lower cylindrical member being formed at a center thereof with a circular channel. The circular channel extends upward from a lower portion of the lower cylindrical member, at a core portion of which a first passage communicating with the space member and ambient, at a circumferential portion of which a second passage communicating with the space member and the space portion, and a first post extends downward from the first disc member and has a predetermined clearance against the second passage, and a circular recess is formed at an upper center portion of the first disc member.

The fifth means includes a second disc member inserted into the circular recess, a second post extending downward from the second disc member and having a predetermined clearance against the first passage, a first O-ring press-fitted between a lower end of the second post and the first passage, and a first compression spring positioned in the circular recess so as to upward urge the second disc member.

According to the feature of the first embodiment, the first passage diverges downward.

The second means includes an upper cylindrical member with an upper portion thereof being opened, the upper cylindrical member being inserted a lower portion thereof into the lower cylindrical member so as to divide the space portion into upper and lower spaces, the second passage being communicated with the upper space. The upper cylindrical member is formed at a lower wall thereof with an opening engaging with the circular channel, the opening being formed at a peripheral portion thereof with a first annular groove into which a second O-ring is inserted so as to block airflow between the upper and lower spaces.

The third means includes a flexible check valve having a dome-like portion at a center thereof, making contact with a lower end of the first post at the first disc member and selectively closing the second passage. The check valve being deformed upward at a circumferential portion thereof when a vacuum is formed in the upper space thereby opening the second passage, and being returned downward when ambient pressure is applied in the upper space thereby closing the second passage.

The first disc member is formed at a peripheral portion thereof with a second outward annular groove. The second annular groove is formed at an upper side location thereof with a third passage communicating with the ambient.

The fourth means includes a third O-ring inserted into the second annular groove, the third O-ring being smaller than the second annular groove in height, being slipped downward between an inner wall of the upper cylindrical member and a lower end of the second annular groove when the upper cylindrical member moves downward, thereby preventing an inflow of the ambient air into the upper space, and being slipped toward an upper end of the second annular groove when the upper cylindrical member moves upward, thereby connecting the upper space and the third passage.

According to a feature of the first embodiment, the upper cylindrical member is formed at a side wall thereof with a fourth passage communicating with the ambient so as to communicate the upper space with the ambient when the lower wall of the upper cylindrical member makes contact with the lower wall of the lower cylindrical member.

A second compression spring is located between an underside of the upper cylindrical member and an upper surface of the lower cylindrical member, thereby upward urging the upper cylindrical member.

The upper cylindrical member is formed at the upper surface thereof with a first step portion and the first disc member is formed at an underside thereof with a second step portion engaging with the first step portion.

The vacuum apparatus further comprises a cover mounted to the upper portion of the upper cylindrical member for facilitating a user the reciprocal movement of the upper cylindrical member. A filter is provided at a lower end portion of the circular channel of the lower cylindrical member.

According to a second embodiment of the present invention, there is provided a vacuum apparatus comprising: a first means for forming a predetermined space portion in which a vacuum or an ambient pressure is applied, the first means being assembled to a space member encircling a predetermined space; a second means for forming a vacuum or an ambient pressure in the space portion by a vertical reciprocal movement thereof, the second means being inserted a lower portion thereof into the first means; a third means for communicating/closing the space member with/from the space portion responding to the reciprocal movement of the upper cylindrical member; and a fourth means for communicating/closing the space portion with/from the ambient responding to the reciprocal movement of the upper cylindrical member.

The first means includes a lower cylindrical member with an upper portion thereof being opened and at a center portion thereof being formed with a stepped circular channel, and a first disc member coupled to the upper portion of the lower cylindrical member so as to define an uppermost position of the second means.

The third means includes a dome-like valve support member inserted into an upper portion of the circular channel and formed at a center thereof with a first passage for communicating the circular channel with the space portion, a disc-like check valve pivotally placed on the valve support member, an operating member having a leg which pushes a side portion of the check valve thereby pivoting the same, and a flexible second disc member for mounting the operating member to the first disc member such that the operating member is vertically movable.

The second means includes an upper cylindrical member with an upper portion thereof being opened, the upper cylindrical member being inserted the lower portion thereof into the lower cylindrical member thereby dividing the space portion into upper and lower spaces, the circular channel communicating with the upper space.

The upper cylindrical member is formed at an underside thereof with an opening inserted around the circular channel. The opening is formed at a peripheral portion thereof with a first annular groove inward opened. A second O-ring for blocking an airflow between the upper and lower spaces is inserted into the first annular groove.

The first disc member is formed at a peripheral portion thereof with a second annular groove outward opened, the second annular groove being formed at an upper end thereof with a third passage communicating the upper space with the ambient.

The fourth means includes a third O-ring inserted into the second annular groove and being smaller than the second annular groove in height, the third O-ring being slipped downward between an inner wall of the upper cylindrical member and a lower end of the second annular groove when the upper cylindrical member moves downward, thereby preventing an inflow of the ambient air into the upper space, and being slipped to an upper end of the second annular groove when the upper cylindrical member moves upward, thereby connecting the upper space and the third passage.

According to a feature of the second embodiment, the upper cylindrical member is formed at a side wall thereof with a fourth passage communicating with the ambient so as to communicate the upper space with the ambient when an underside of the upper cylindrical member makes contact with the lower wall of the lower cylindrical member.

When the upper cylindrical member moves downward, the second disc member is underlaid at an upper surface thereof with an ambient pressure and at an underside thereof with a vacuum, thereby being deformed downward so that the leg of the operating member pushes a side portion of the check valve so as to pivot the same and an airflow is generated through the first passage from the space member to the upper space, and sequentially when the upper cylindrical member moves lowermost position such that the lower wall of the upper cylindrical member makes contact with the lower wall of the lower cylindrical member, the fourth passage is opened thereby communicating the upper space with the ambient and applying an ambient pressure to the underside of the second disc member so that the second disc member returns upward and the check valve closes the first passage.

A second compression spring is located between an underside of the upper cylindrical member and an upper surface of the lower cylindrical member, thereby upward urging the upper cylindrical member.

The upper cylindrical member is formed at the upper surface thereof with a first step portion and the first disc member is formed at an underside thereof with a second step portion engaging with the first step portion.

The vacuum apparatus further comprises a cover mounted to the upper portion of the upper cylindrical member for facilitating for a user the reciprocal movement of the upper cylindrical member.

A filter is provided at a lower end portion of the circular channel of the lower cylindrical member.

As described above, the first and the second embodiments achieves that a high vacuum is easily formed inside of the space member such as a bottle, a medical evacuation instrument or the like and is maintained stably.

BRIEF DESCRIPTION OF THE DRAWINGS

The above object and other advantages of the present invention will become more apparent by describing in detail preferred embodiments thereof with reference to the attached drawings in which.

DETAILED DESCRIPTION OF THE INVENTION

Hereinafter, preferred embodiments of the present invention will be explained in more detail with reference to FIGS. 5 to 18.

A vacuum apparatus according to the present invention can be adapted in a vacuum bottle, a medical instrument, a vacuum enclosure or the like, however hereinafter, the vacuum apparatus will be explained when the apparatus is adapted in a vacuum bottle. The vacuum apparatus according to the present invention is achieved by first and second preferred embodiments. The first and second embodiments are virtually the same with the exception of the configurations of the selectively operatable check valve.

First Preferred Embodiment

Figure 1:
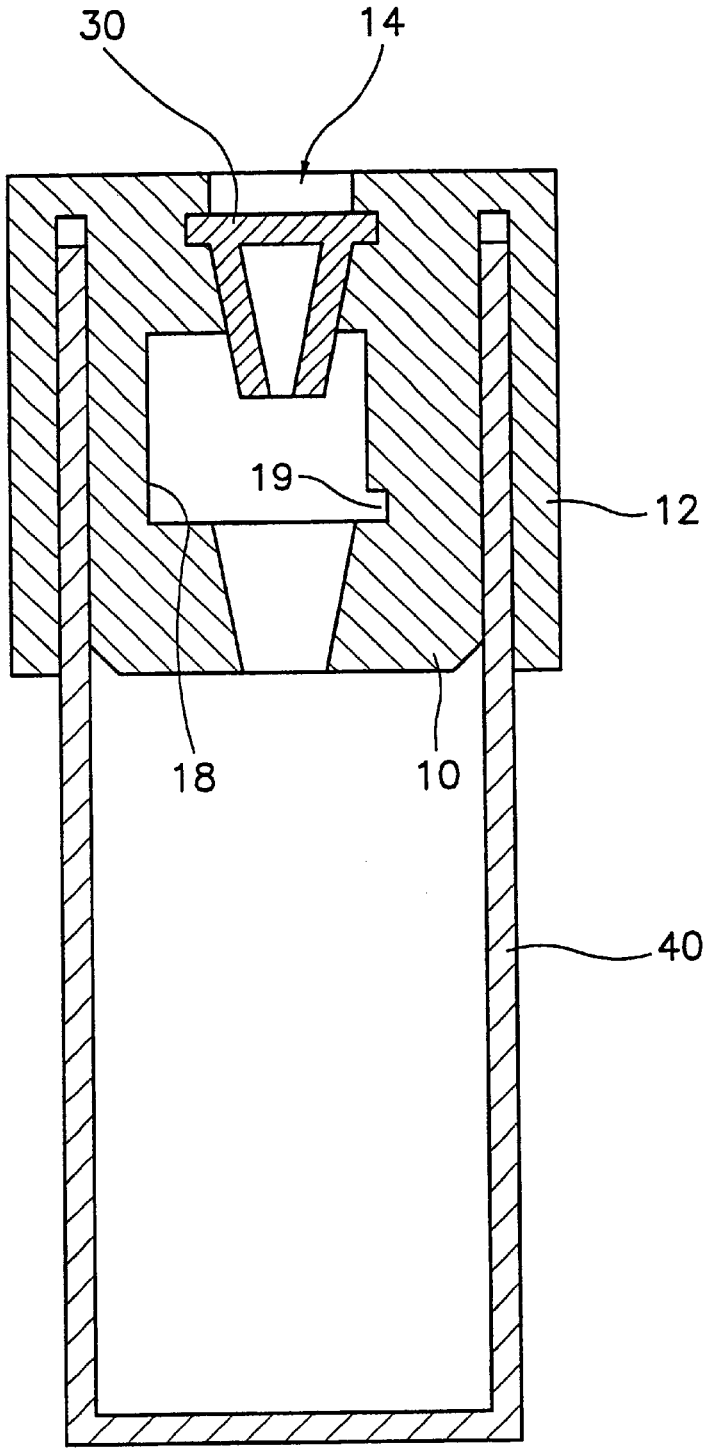
FIGS. 1 to 4 are sectional views showing a conventional sealing cap.
Figure 2:
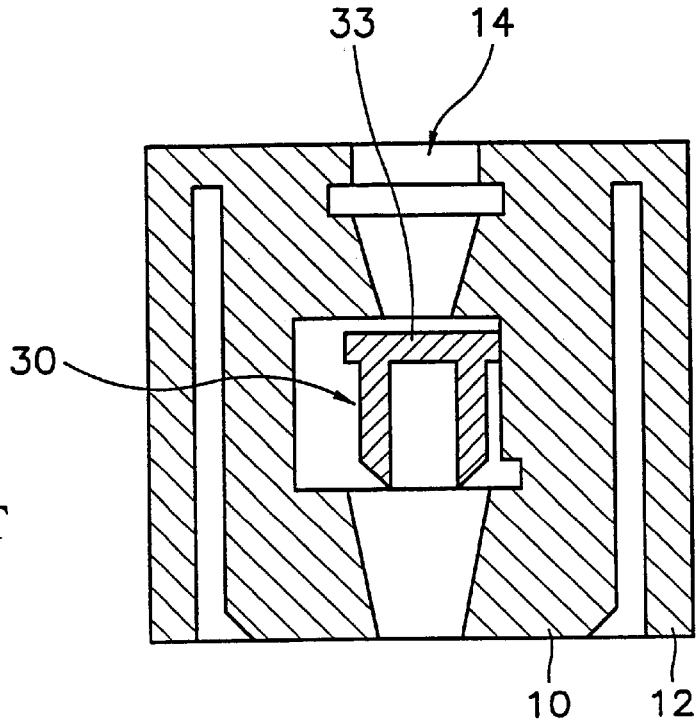
Figure 3:
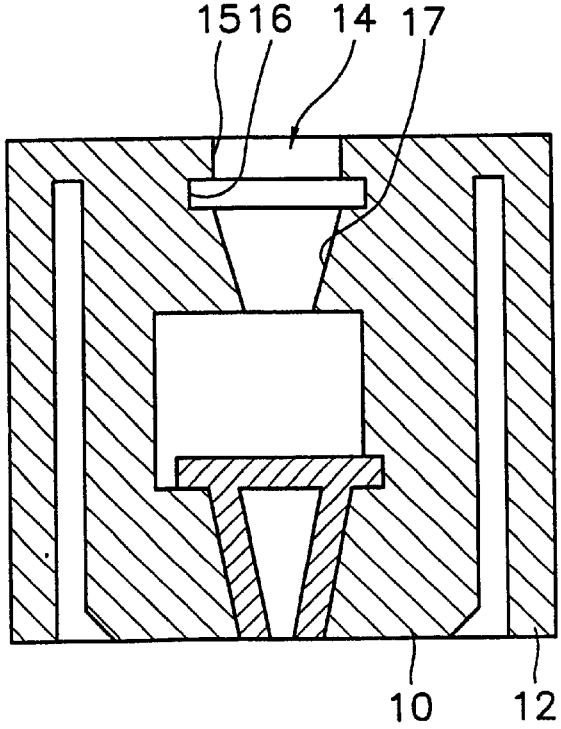
PRIOR ART FIG. 3
Figure 4:
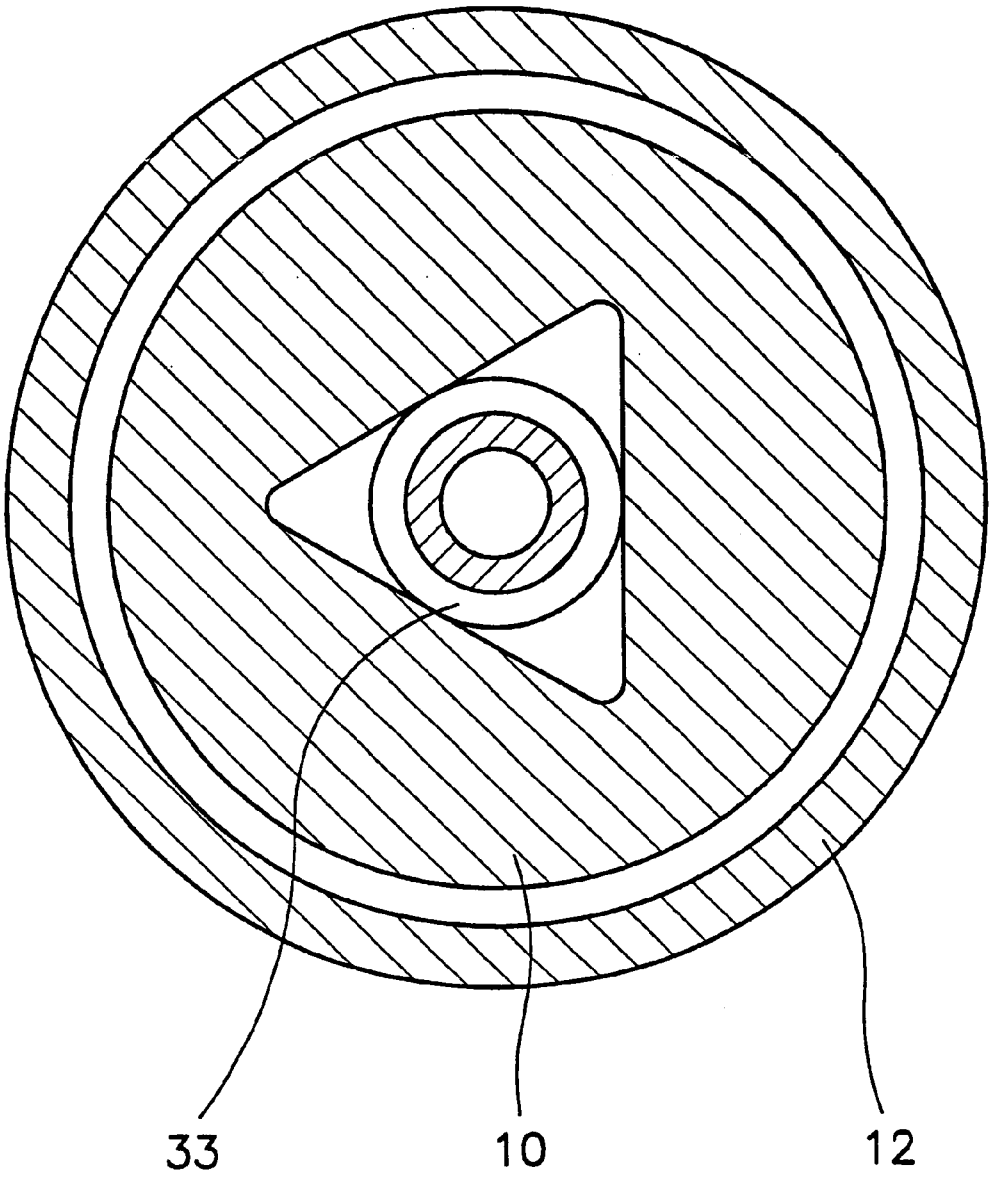
Figure 5:
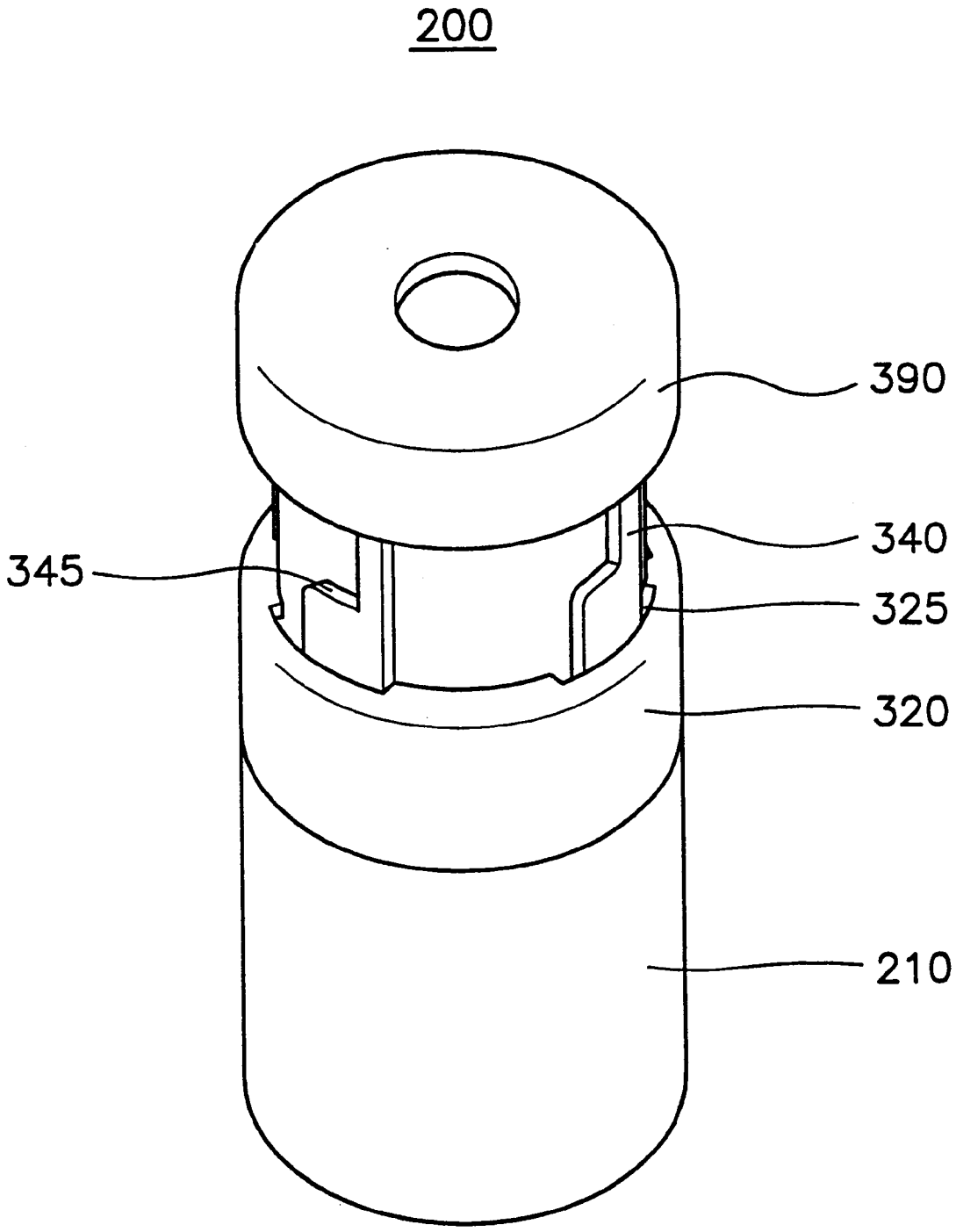
FIG. 5 is a perspective view of a vacuum bottle adapted with a vacuum apparatus in accordance with the present invention.
Figure 6:
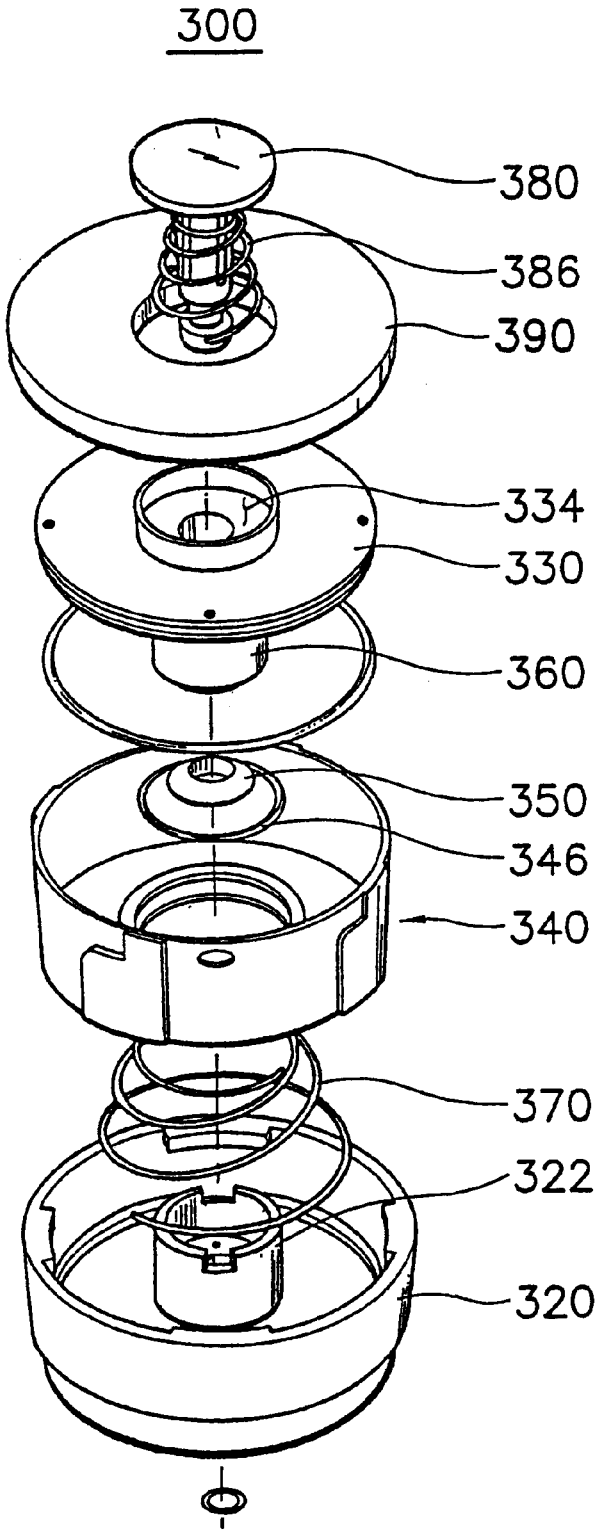
FIG. 6 is an exploded perspective view of a vacuum apparatus in accordance with a first preferred embodiment of the present invention.
Figure 7:
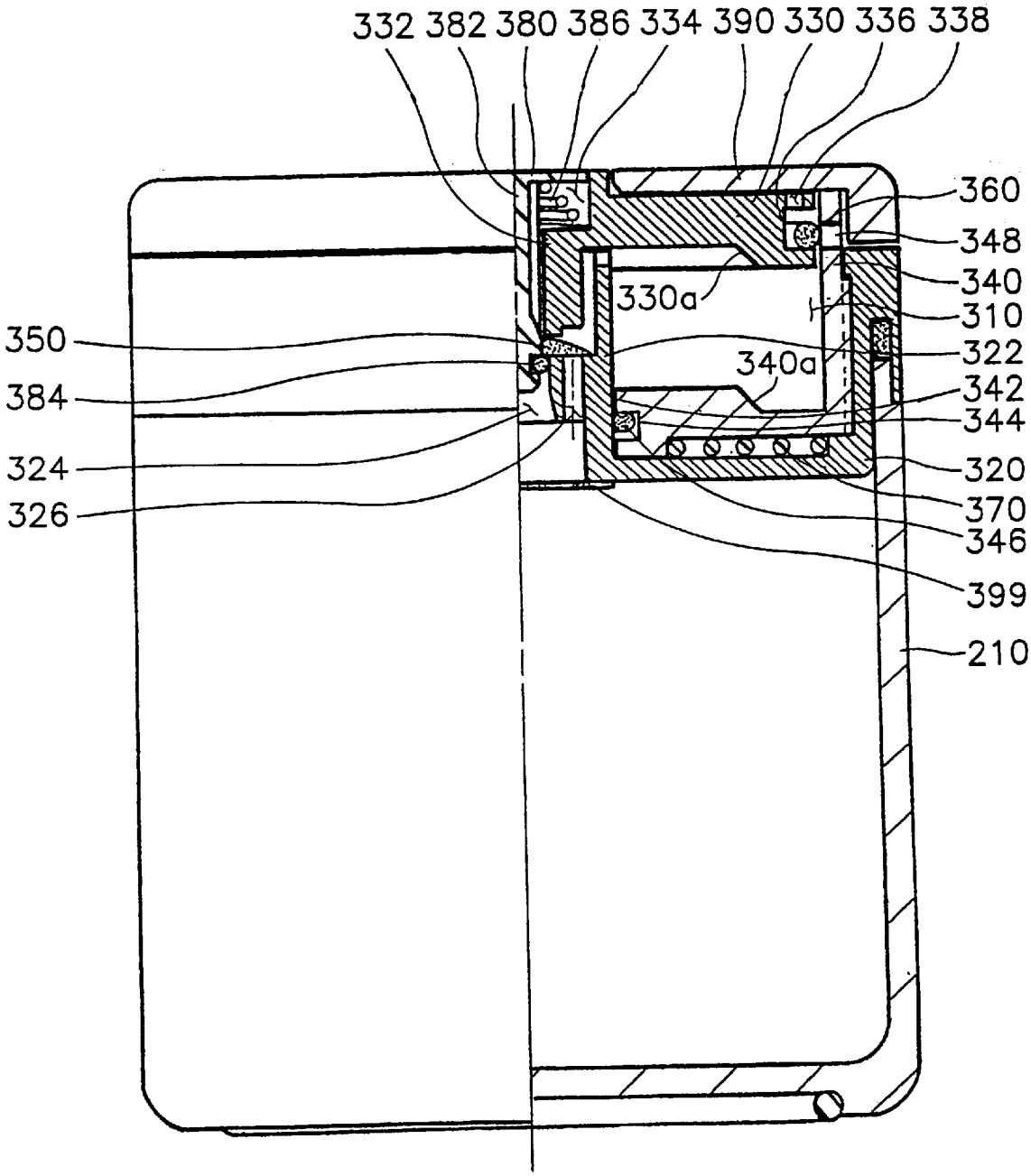
FIG. 7 is a partial sectional view of the vacuum bottle in which a vacuum is formed by the vacuum apparatus.

FIGS. 6 and 7 are respectively exploded and assembled views of a vacuum apparatus 300.

Referring to FIGS. 6 and 7, a vacuum apparatus 300 is assembled to a bottle 210 with an upper portion thereof being opened and evacuates an inside of bottle 210 by repetitive pumping operations. Vacuum apparatus 300 comprises a lower cylindrical member 320 with an upper portion thereof being opened and a first disc member 330 assembled to the upper portion of lower cylindrical member 320. Lower cylindrical member 320 is formed at a center thereof with a circular channel 322. Circular channel 322 extends upward from a lower portion of lower cylindrical member 320, at a core portion of which a first passage 324 communicating the inside of bottle 210 with ambient, and at a circumferential portion of which an annular second passage 326 communicating the inside of bottle 210 with space portion 310 are formed.

First disc member 330 confines the uppermost position of an upper cylindrical member which engages with circular channel 322. A first post 332 extends downward from first disc member 330 and has a predetermined clearance against second passage 326. A circular recess 334 is formed at an upper center portion of first disc member 330.

Figure 8:
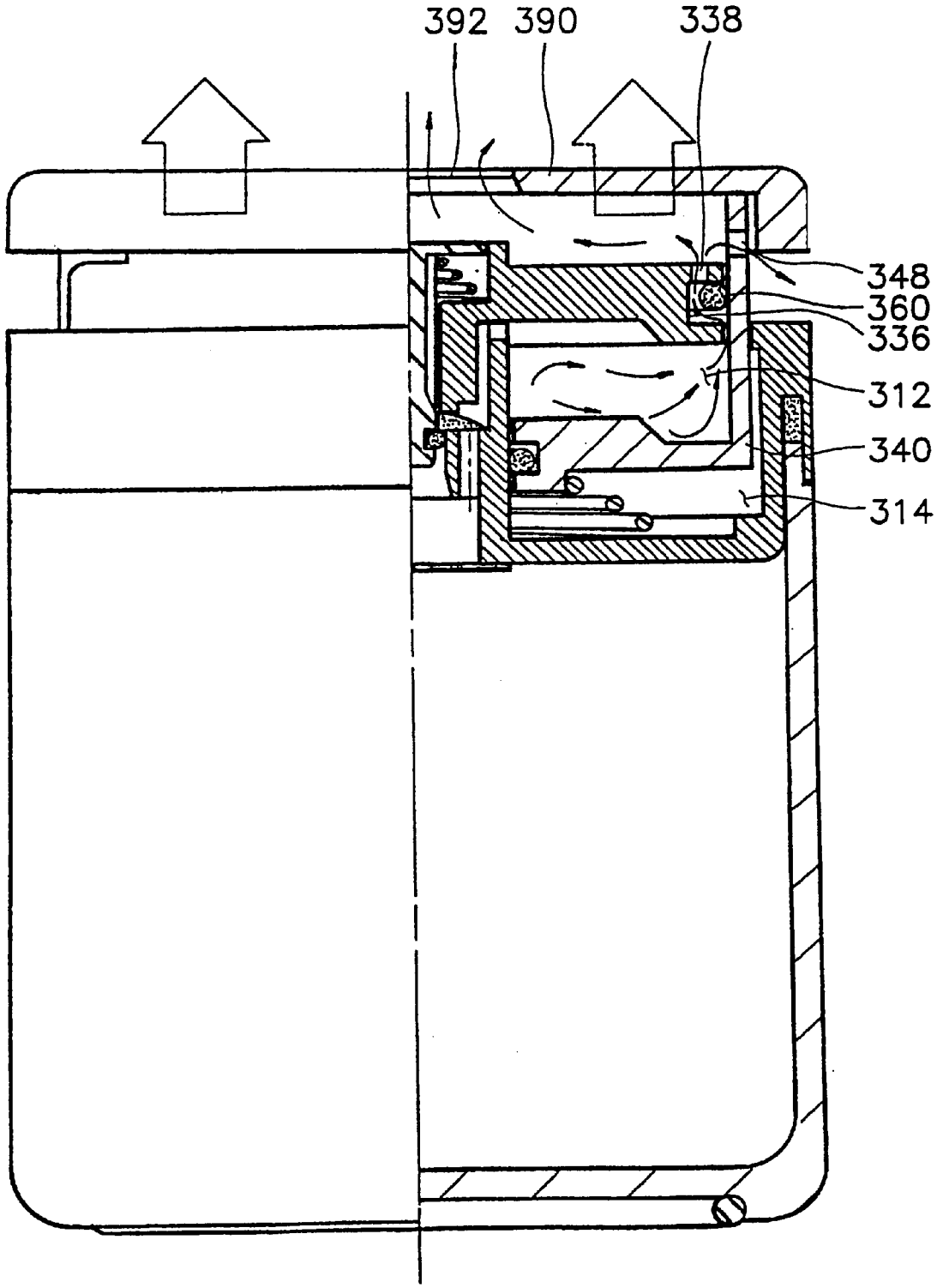
FIG. 8 is a partial sectional view of the vacuum bottle wherein an upper cylindrical member is moving upward.

According to the first embodiment, there is provided an upper cylindrical member 340 with an upper portion thereof being opened. Upper cylindrical member 340 is inserted a lower portion thereof into lower cylindrical member 320 so as to divide space portion 310 into compressible and expandable upper and lower spaces 312 and 314, as shown in FIG. 8.

Second passage 326 around circular channel 322 communicates with upper space 312 to serve as an air passage. Upper cylindrical member 340 is formed at a lower wall thereof with an opening 342 engaging with circular channel 322, opening 342 being formed at a inner peripheral portion thereof with a first annular groove 344. Preferably, a second O-ring 346 is inserted so as to block an airflow between upper and lower spaces 312 and 314.

Figure 10:
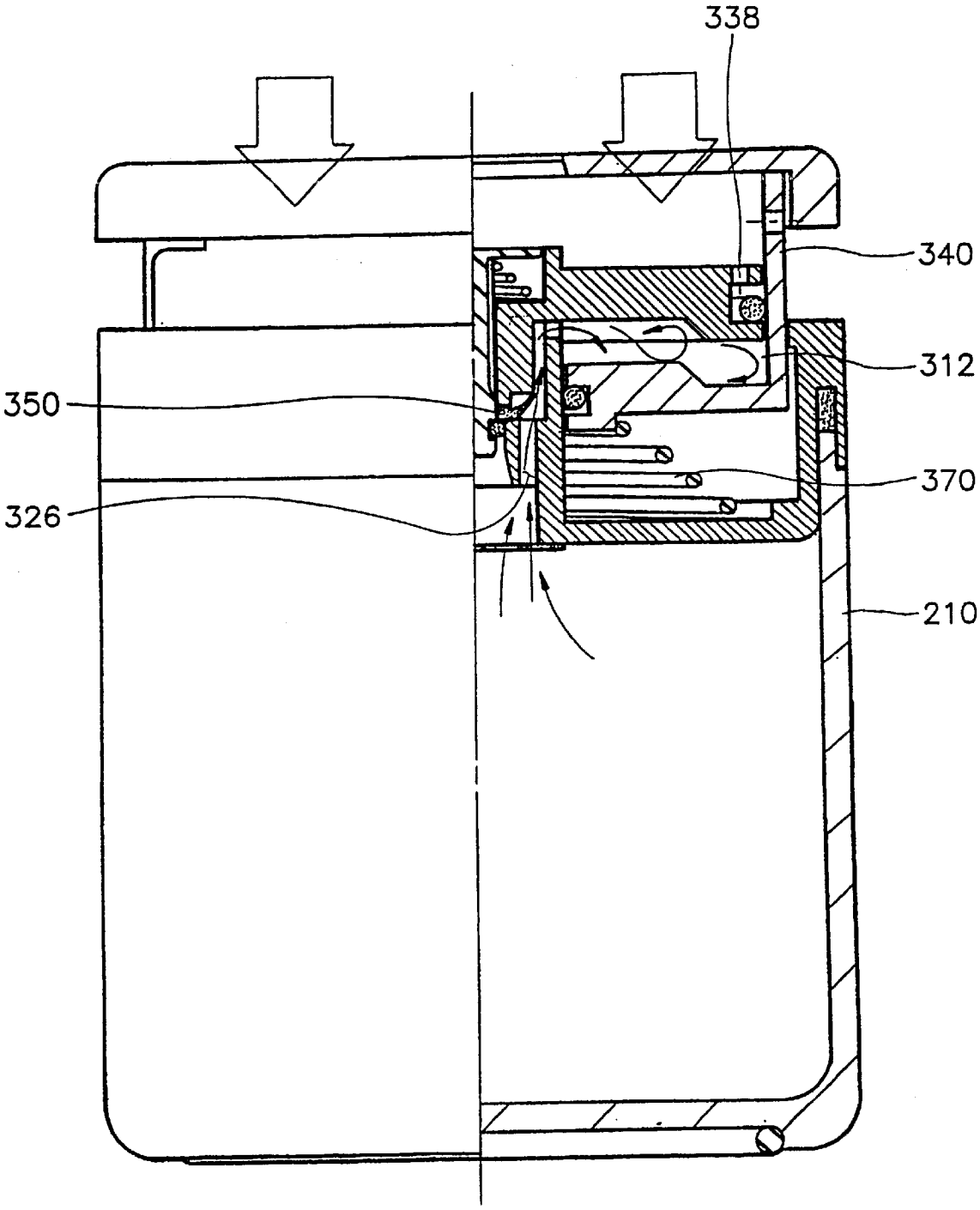
FIG. 10 is a partial sectional view of the vacuum bottle wherein the upper cylindrical member is moving downward.
Figure 11:
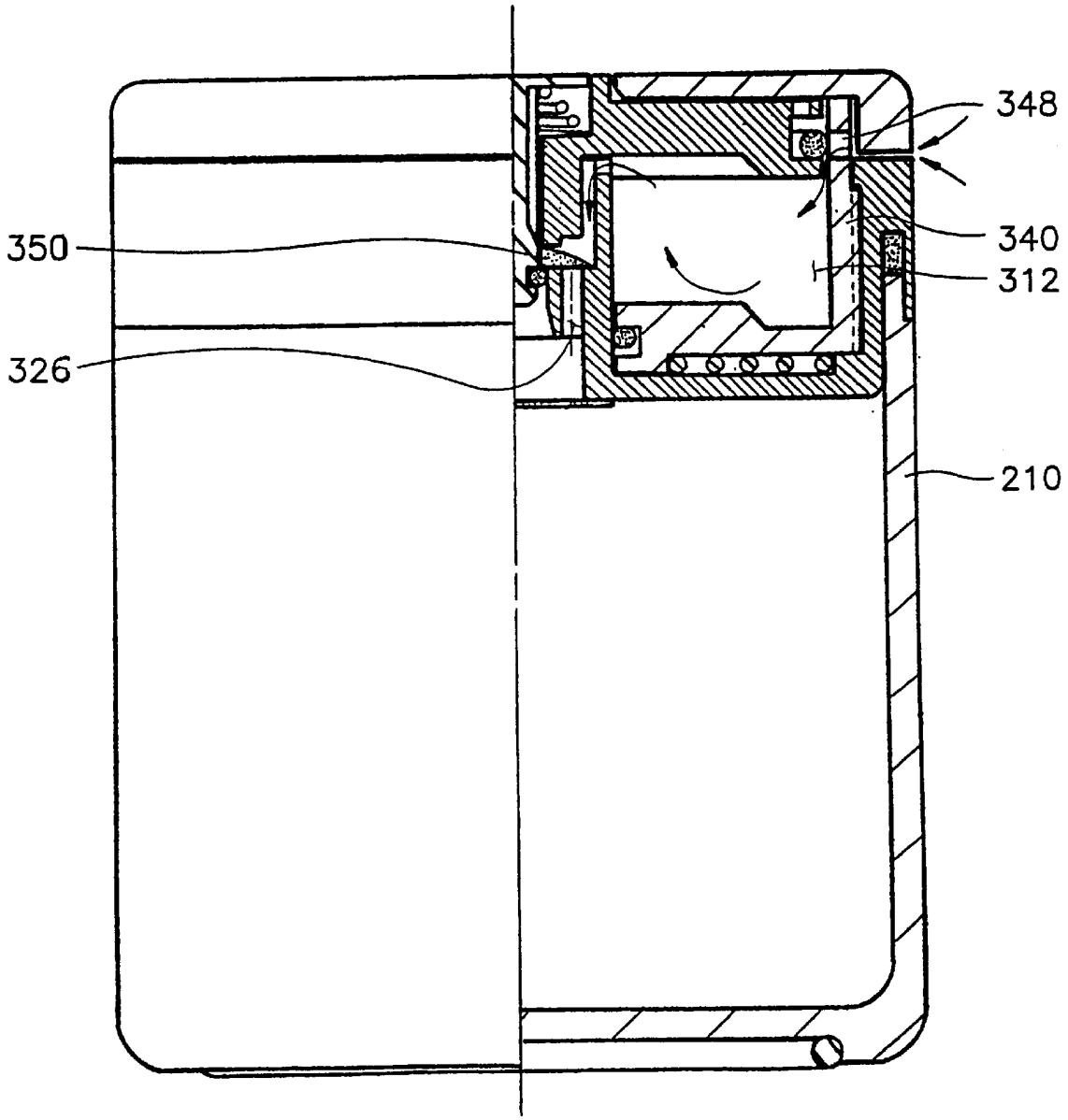
FIG. 11 is a partial sectional view of the vacuum bottle wherein the upper cylindrical member has reached to its lowermost position.

According to a feature of the first embodiment, there is provided a flexible check valve 350 having a dome-like portion at a center thereof. Check valve 350 makes contact with a lower end of first post 332 at first disc member 330 and selectively closes second passage 326. Preferably, check valve 350 is made of elastomeric material, and as shown in FIG. 10, is deformed upward at a circumferential portion thereof when a vacuum is formed in upper space 312 thereby opening second passage 326. As shown in FIG. 11, check valve 350 returns downward when ambient pressure is applied in upper space 312 thereby closing second passage 326.

On the other hand, first disc member 330 is formed at a peripheral portion thereof with a second outward annular groove 336. Second annular groove 336 is formed at an upper side location thereof with a third passage 338 communicating with ambient. According to a feature of the first embodiment, a third O-ring 360 is inserted into second annular groove 336, being smaller than second annular groove 336 in height. Third O-ring 360 is slipped downward between an inner wall of upper cylindrical member 340 and a lower end of second annular groove 336 at first disc member 330 when upper cylindrical member 340 moves downward, as shown in FIG. 10, thereby preventing an inflow of ambient air into upper space 312, and is slipped toward an upper end of second annular groove 336 when upper cylindrical member 340 moves upward, thereby connecting upper space 312 and third passage 338.

According to a feature of the first embodiment, upper cylindrical member 340 is formed at a side wall thereof with a fourth passage 348 communicating with ambient so as to communicate upper space 312 with ambient when the lower wall of upper cylindrical member 340 makes contact with the lower wall of lower cylindrical member 320. Fourth passage 348 is located such that it communicates with ambient when upper and lower cylindrical members 340 and 320 overlap.

Meanwhile, a second compression spring 370 is located between an underside of upper cylindrical member 340 and an upper surface of lower cylindrical member 320, thereby upward urging upper cylindrical member 340.

Preferably, upper cylindrical member 340 is formed at the upper surface thereof with a first step portion 340*a* and first disc member 330 is formed at an underside thereof with a second step portion 330*a* engaging with first step portion 340*a*. This makes upper space 312 to be fully pressed so that upper space 312 can evacuate more air from bottle 210 when upper cylindrical member 320 moves downward.

According to a feature of the first embodiment, there is provided a second disc member 380 inserted into circular recess 334, and a second post 382 extending downward from second disc member 380 and having a predetermined clearance against first passage 324. A first O-ring 384 is press-fitted between a lower end of second post 382 and first passage 324 so as to close first passage 324. In circular recess 334, a first compression spring 386 is positioned so as to upward urge second disc member 380. At this time, first passage 324 diverges downward.

Preferably, vacuum apparatus 300 further comprises a cover 390 mounted to the upper portion of upper cylindrical member 340 for facilitating for a user the reciprocal movement of upper cylindrical member 340. On the other hand, a filter 399 is provided at a lower end portion of circular channel 322 of lower cylindrical member 320.

Hereinafter, the operation of vacuum apparatus 300 in accordance with the first embodiment of the present invention will be explained with reference to the sequentially drafted drawings.

FIG. 7 shows the vacuum bottle wherein a vacuum is formed inside of bottle 210. Upper and lower cylindrical members 340 and 320 are formed at the opposing surfaces therebetween with protrusions and recesses which engage with each other, and they are assembled by a relative rotation therebetween. At this time, upper cylindrical member 340 is fully pressed down to the lowermost position. There is formed a vacuum in bottle 210 and space portion 310 communicates with ambient through fourth passage 348. Accordingly, an ambient pressure is applied on the upper surface of check valve 350 and a vacuum is applied on the underside thereof so that it blocks second passage 326.

As upper cylindrical member 340 moves upward, as shown in FIG. 8, the air in upper space 312 flows out through third passage 338 and continuously flows through a discharge hole 392 and fourth passage 348, thereby being vented to the ambient. At this time, third O-ring 360 is pressed against the upper end of second annular groove 336 so that third passage 338 communicates with upper space 312.

Figure 9:
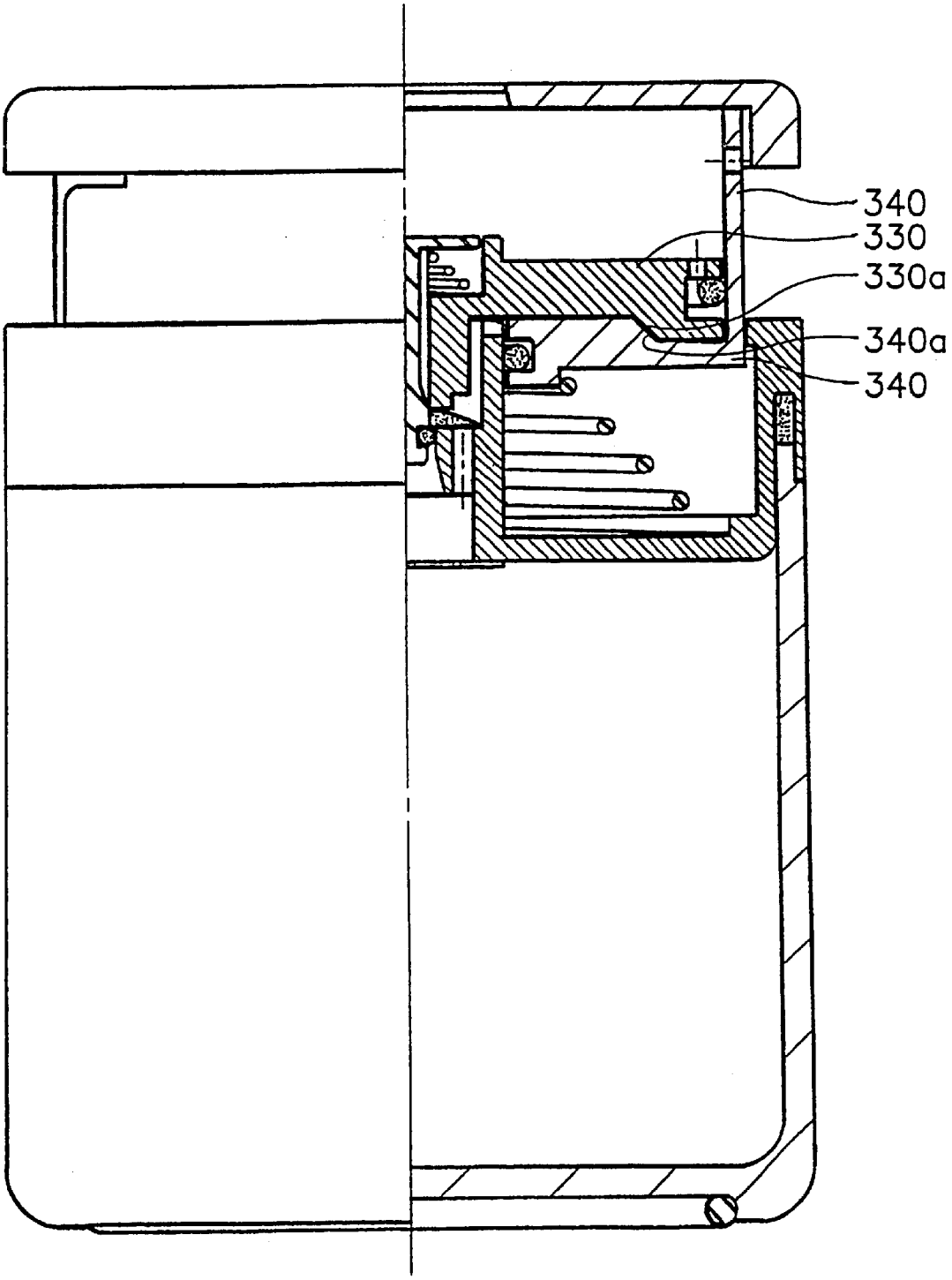
FIG. 9 is a partial sectional view of the vacuum bottle wherein the upper cylindrical member has reached to its uppermost position.

As upper cylindrical member 340 moves up to its uppermost position, as shown in FIG. 9, first and second step portions 340*a* and 330*a* entirely engages to each other, thereby evacuating upper space 312.

As upper cylindrical member 340 descends, as shown in FIG. 10, upper space 312 is expanded again. At this time, third O-ring 360 is pressed against the lower end of second annular groove 336 by the upper cylindrical member 340 so as to close third passage 338 from upper space 312. Accordingly, there is formed a vacuum in upper space 312 and thus the vacuum is applied on the upper surface of check valve 350. At this time, the vacuum in upper space 312 is higher than that of bottle 210 so that the circumferential portion of check valve 350 is upward deformed, thereby communicating second passage 326 with upper space 312. Therefore, the air inside of bottle 210 is retrieved into upper space 312. Since upper cylindrical member 340 is upward urged by second compression spring 370, a user must push down upper cover 390.

When upper cylindrical member 340 moves down to the lowermost position as shown in FIG. 11, fourth passage 348 connects the ambient with upper space 312. Accordingly, the ambient pressure is applied on the upper surface of check valve 350, thereby returning check valve 350 downward and closing second passage 326.

In brief, the procedures sequentially shown in FIGS. 7 to 11 are repeated in order to withdraw the air inside of bottle 210 to form a high vacuum state therein.

Figure 12:
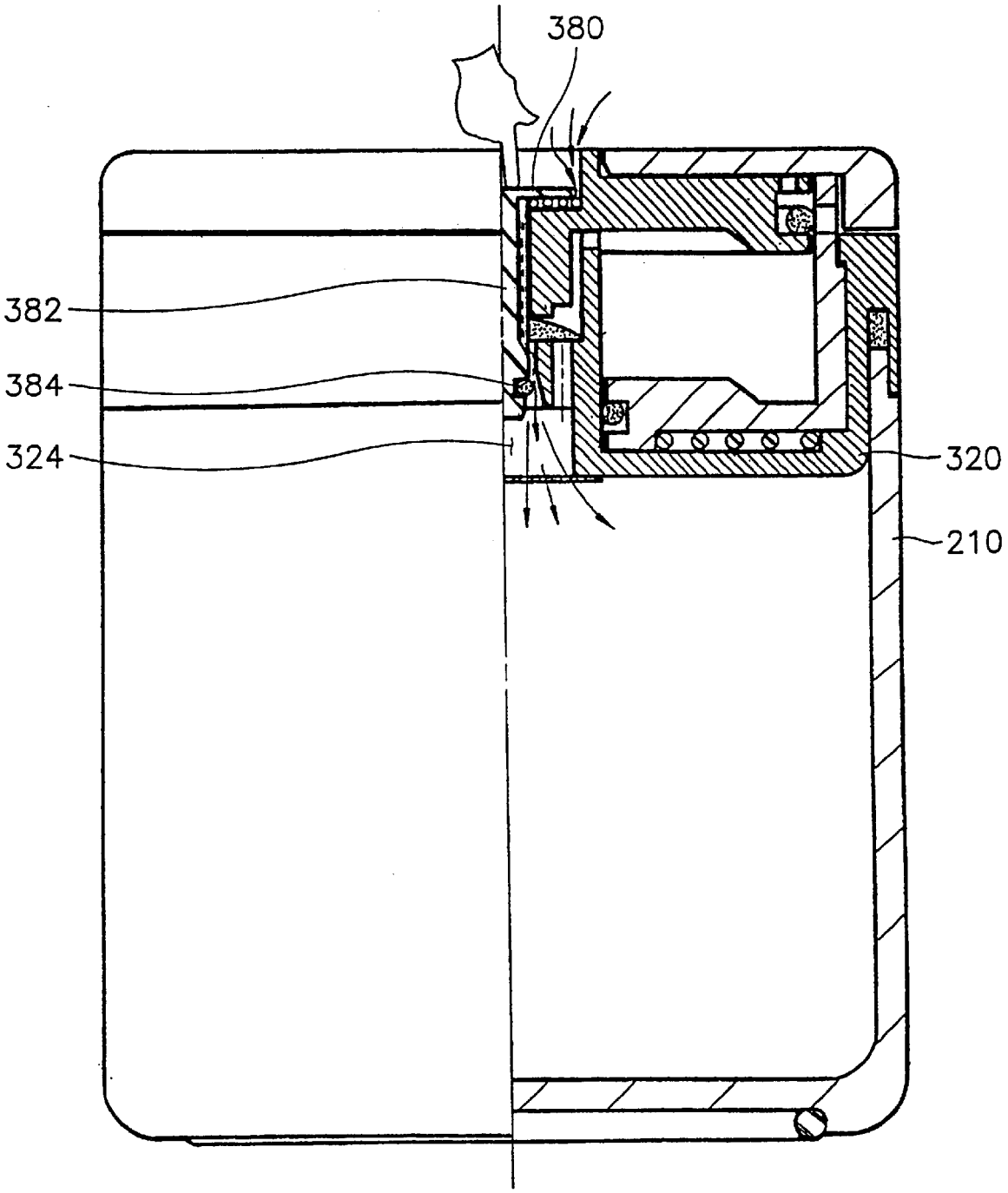
FIG. 12 is a partial sectional view which illustrates the release of vacuum in the bottle in accordance with the first preferred embodiment of the present invention.

FIG. 12 illustrates the release of the vacuum in bottle 210. When the user pushes down second disc member 380 manually, second post 382 moves downward and first O-ring 384 is slipped down. Since first passage 234 diverges downward, there is formed a passage between second post 382 and first passage 324, so that the outside ambient air inflows into bottle 210 therethrough. Thus, the vacuum in bottle 210 is released and lower cylindrical member 320 easily separates from bottle 210.

Second Preferred Embodiment

Figure 13:
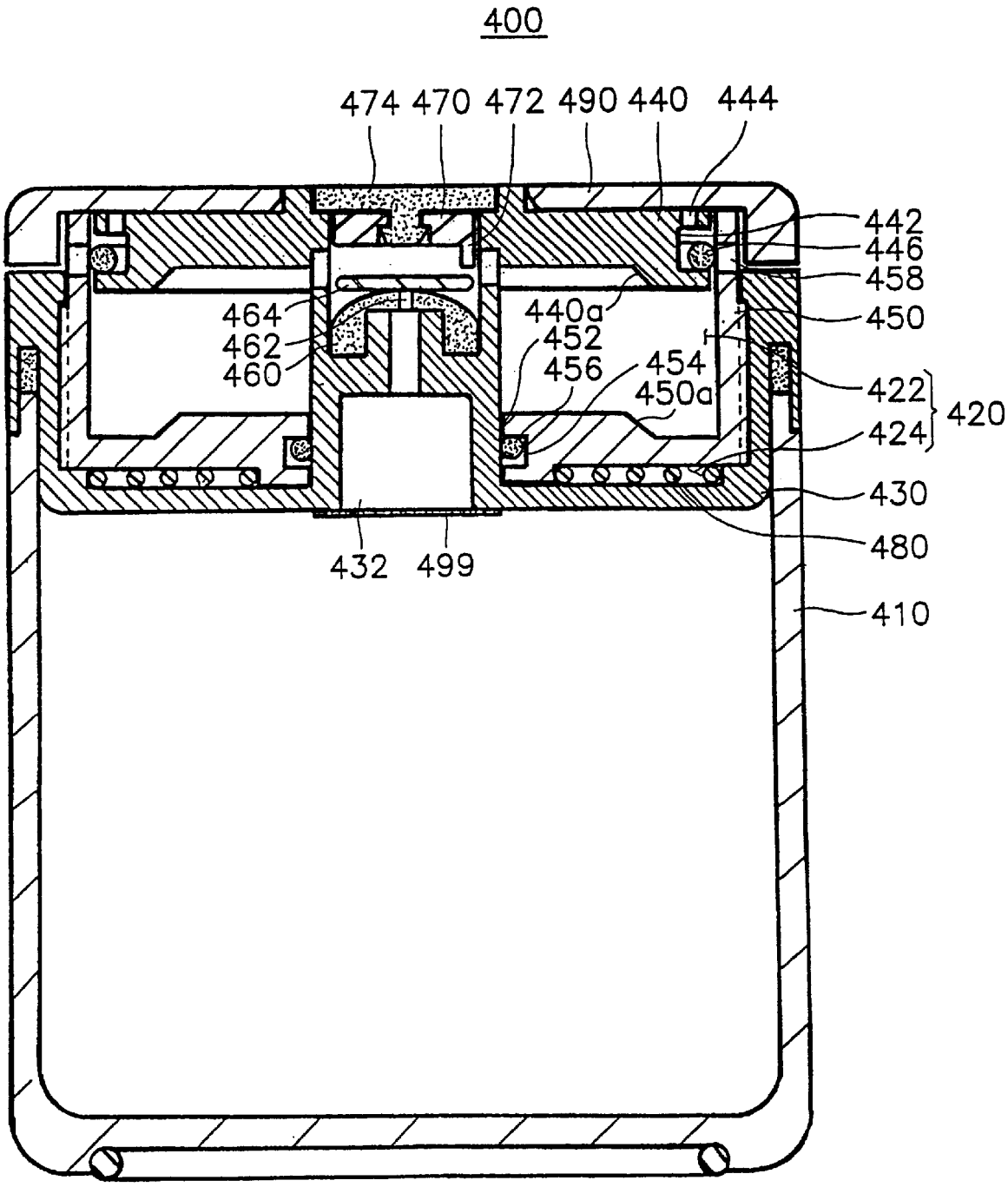
FIG. 13 is a partial sectional view wherein a vacuum is formed in a bottle by a vacuum apparatus in accordance with a second preferred embodiment of the present invention.

FIG. 13 shows a vacuum apparatus 400 in accordance with a second preferred embodiment of the present invention.

Referring to FIG. 13, vacuum apparatus of the second embodiment comprises a means for forming a predetermined space portion 420 in which a vacuum or an ambient pressure is applied. The means is assembled to a bottle or the like 410. The means includes a lower cylindrical member 430 with an upper portion thereof being opened and at a center portion thereof being formed with a stepped circular channel 432, and a first disc member 440 coupled to the upper portion of lower cylindrical member 430.

There is provided a means for forming a vacuum or an ambient pressure in space portion 420 by a vertical reciprocal movement thereof. The means includes an upper cylindrical member 450 with an upper portion thereof being opened. Upper cylindrical member 450 is inserted the lower portion thereof into lower cylindrical member 430 thereby dividing space portion 420 into upper and lower spaces 422 and 424, and the vertical movement thereof is restrained by first disc member 440 and lower cylindrical member 430. Circular channel 432 communicates with upper space 422.

Preferably, upper cylindrical member 450 is formed at an underside thereof with an opening 452 inserted around circular channel 432. Opening 452 is formed at a peripheral portion thereof with a first annular groove 454 inward opened. A second O-ring 456 for blocking an airflow between upper and lower spaces 422 and 424 is inserted into first annular groove 454. A second compression spring 480 is located between an underside of upper cylindrical member 450 and an upper surface of lower cylindrical member 430, thereby upward urging upper cylindrical member 450.

According to a feature of the invention, there is provided a means for communicating/closing bottle 410 with/from space portion 420 responding to the reciprocal movement of upper cylindrical member 450. The means includes a dome-like valve support member 460 inserted into an upper portion of circular channel 432 and formed at a center thereof with a first passage 462 for communicating circular channel 432 with space portion 420, a disc-like check valve 464 pivotally placed on valve support member 460, an operating member 470 having a leg 472 which pushes a side portion of check valve 464 thereby pivoting the same, and a flexible second disc member 474 for mounting operating member 470 to first disc member 440 such that operating member 470 is vertically movable. There are formed a protruded portion at second disc member 474 and a through hole at operating member 470 which engage with each other whereby they are resiliently assembled.

On the other hand, first disc member 440 is formed at a peripheral portion thereof with a second annular groove 442 outward opened. At an upper end of second annular groove 442, there is formed a third passage 444 communicating upper space 422 with ambient.

According to the second embodiment of the present invention, there is provided a third O-ring 446 inserted into second annular groove 442 and being smaller than second annular groove 442 in height. Third O-ring 446 is slipped downward between an inner wall of upper cylindrical member 450 and a lower end of second annular groove 442, when upper cylindrical member 450 moves downward, thereby preventing an inflow of the ambient air into upper space 422, and on the contrary, is slipped to an upper end of second annular groove 442 when upper cylindrical member 450 moves upward, thereby connecting upper space 442 and third passage 444.

According to the present invention, upper cylindrical member 450 is formed at a side wall thereof with a fourth passage 458 communicating with the ambient so as to communicate upper space 422 with the ambient, when an underside of upper cylindrical member 450 makes contact with the lower wall of lower cylindrical member 430.

When upper cylindrical member 450 moves downward, second disc member 474 is underlaid at an upper surface thereof with an ambient pressure and at an underside thereof with a vacuum, thereby being deformed downward so that leg 472 of operating member 470 pushes a side portion of check valve 464 so as to pivot the same and an airflow is generated through first passage 462 from bottle 410 to upper space 422. Furthermore and sequentially, when upper cylindrical member 450 moves lowermost position such that the lower wall of upper cylindrical member 450 makes contact with the lower wall of lower cylindrical member 430, fourth passage 458 is opened thereby communicating upper space 422 with the ambient and applying an ambient pressure to the underside of second disc member 474 so that second disc member 474 returns upward and check valve 464 closes first passage 462.

Preferably, upper cylindrical member 450 is formed at the upper surface thereof with a first step portion 450*a* and first disc member 440 is formed at an underside thereof with a second step portion 440*a* engaging with first step portion 450*a*. This makes the inside of upper space 422 be squeezed when upper cylindrical members 450 and first disc member 440 meet so that a suction force generated due to the expansion of upper space 422 is maximized.

In addition, vacuum apparatus 400 further comprises a cover 490 mounted to the upper portion of upper cylindrical member 450 for facilitating for a user the reciprocal movement of upper cylindrical member 450.

Meanwhile, a filter 499 is provided at a lower end portion of circular channel 432 of lower cylindrical member 430.

Hereinafter, the operation of vacuum apparatus 400 will be explained with reference to the accompanying and sequentially drawn figures.

FIG. 13 shows vacuum apparatus 400 wherein upper cylindrical member 450 moves down to the lowermost position. At this time, upper and lower cylindrical members 450 and 430 are engaged by a rotation therebetween. Second disc member 474 is underlaid at the upper surface thereof being applied with the ambient pressure and at the underside thereof being applied with the ambient pressure since fourth passage 458 makes upper space 422 communicate with the ambient. Accordingly, second disc member 474 and operating member 470 remain unchanged. Also, check valve 464 is underlaid at the upper surface thereof being applied with the ambient pressure and at the underside thereof being applied with a vacuum so that it maintains its original horizontal position and blocks second passage 462.

Figure 14:
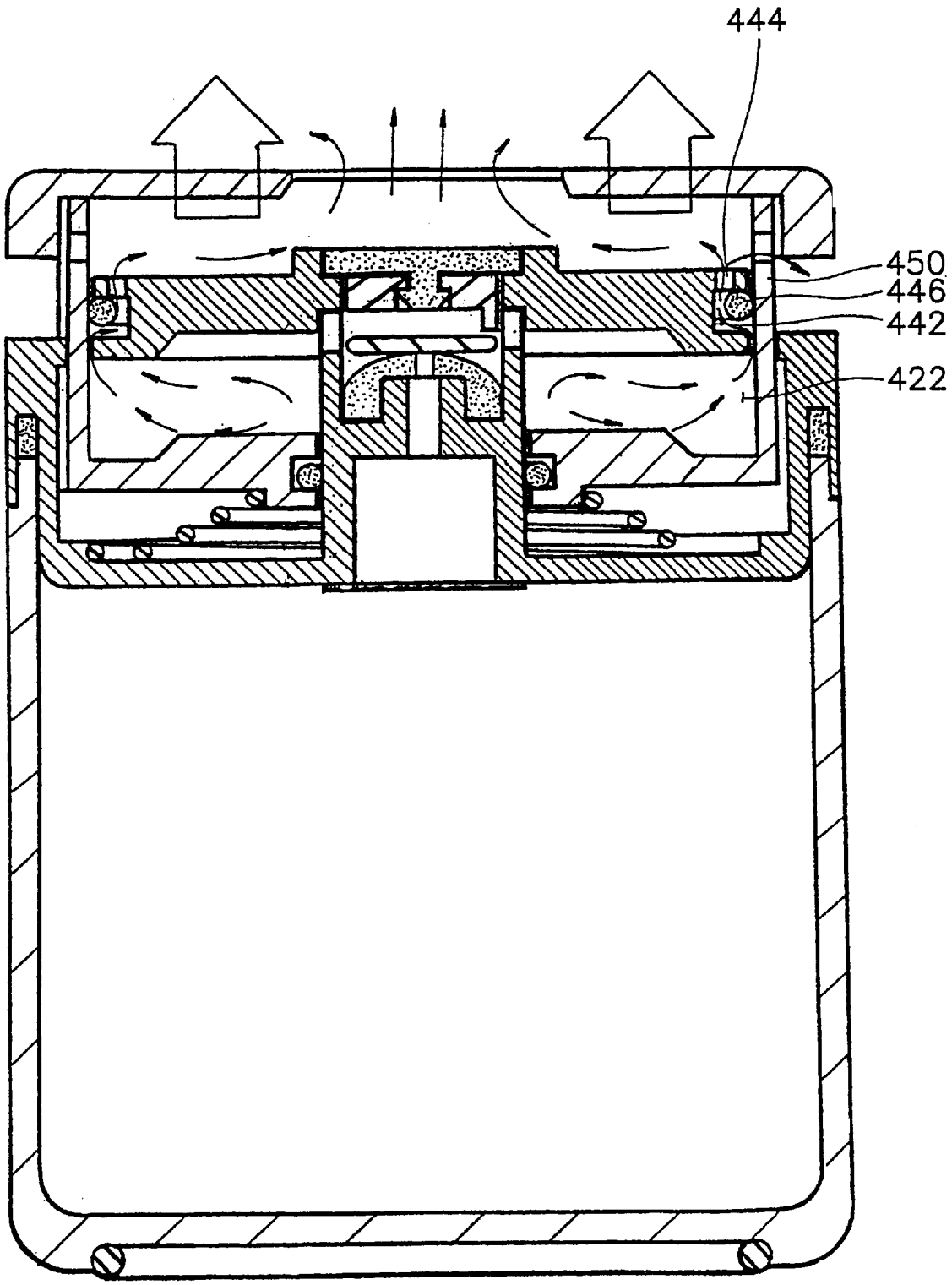
FIG. 14 is a partial sectional view of the vacuum bottle shown in FIG. 13 wherein an upper cylindrical member is moving upward.

As upper cylindrical member 450 moves upward as shown in FIG. 14, the air in upper space 422 is vented to the ambient through third passage 444. At this time, third O-ring 446 is pressed against the upper end of second annular groove 442, thereby communicating upper space 422 with third passage 444.

Figure 15:
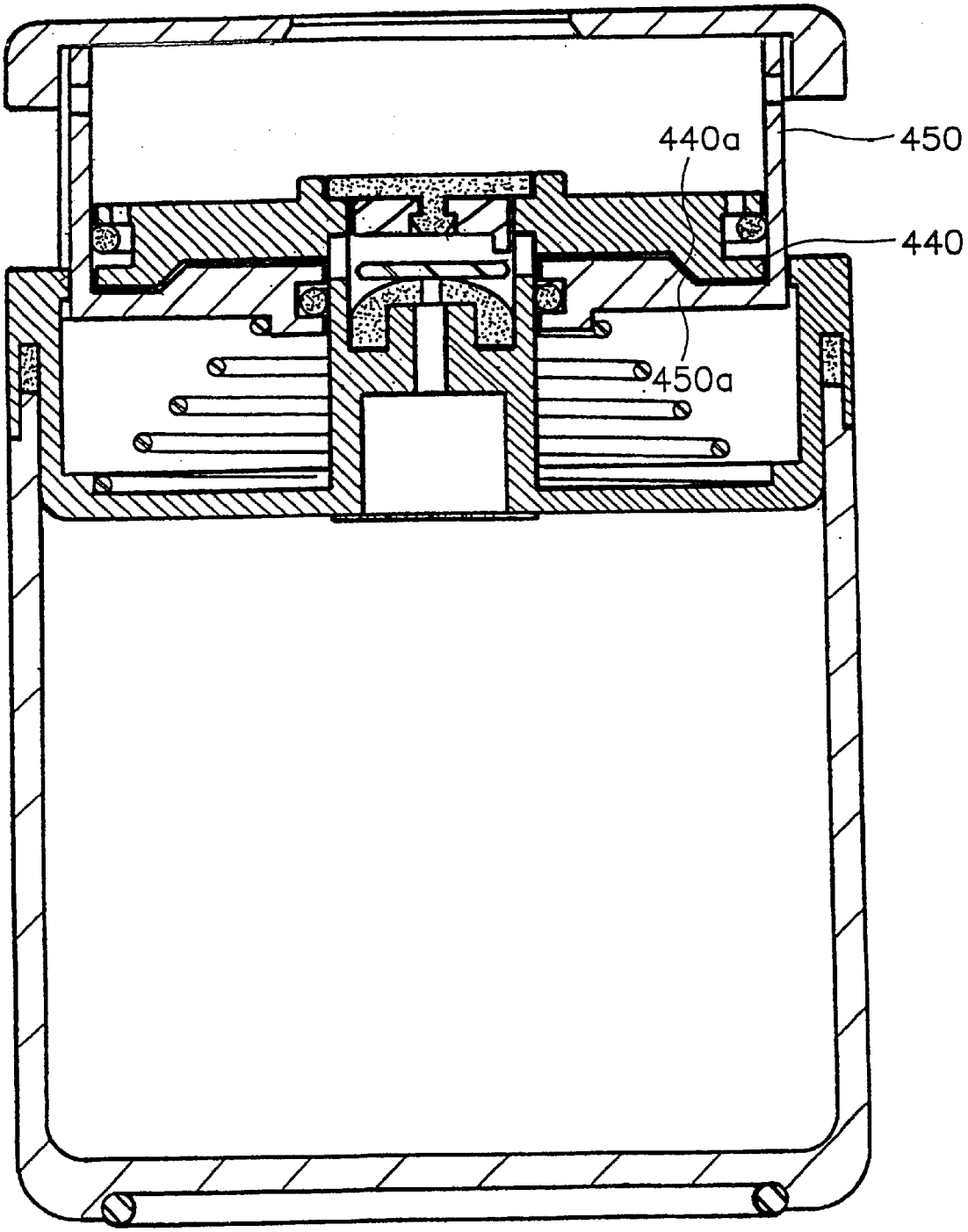
FIG. 15 is a partial sectional view of the vacuum bottle wherein the upper cylindrical member has reached its uppermost position.

As upper cylindrical member 450 moves uppermost as shown in FIG. 15, first and second step portions 450*a* and 440*a* is entirely engaged so that the air inside of upper space 422 is squeezed.

Figure 16:
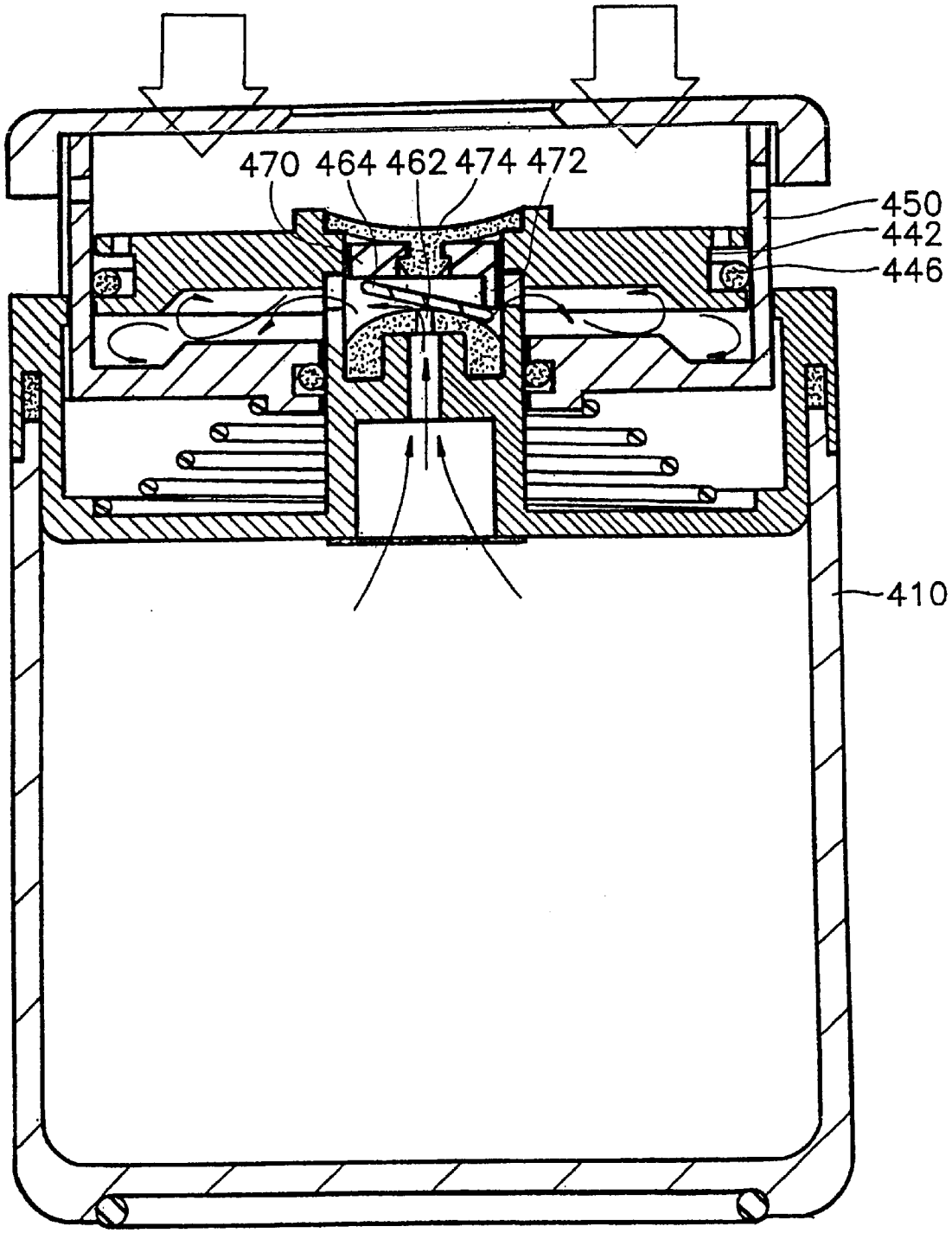
FIG. 16 is a partial sectional view of the vacuum bottle wherein the upper cylindrical member is moving downward.

As upper cylindrical member moves downward as shown in FIG. 16, third O-ring 446 is pressed against the lower end of second annular groove 442 so as to close upper space 422 from the outside thereof. Accordingly, the inner pressure of upper space 422 gradually decreases so that there is applied a pressure on the underside of second disc member 474 lower than the atmospheric pressure. Thus, second disc member 474 deforms downward and accordingly leg 472 of operating member 470 pushes down a side of check valve 464 so as to pivot the same. As a result, first passage 462 communicates with upper space 422 so that the air inside of bottle 410 flows into upper space 422, thereby evacuating bottle 410.

Figure 17:
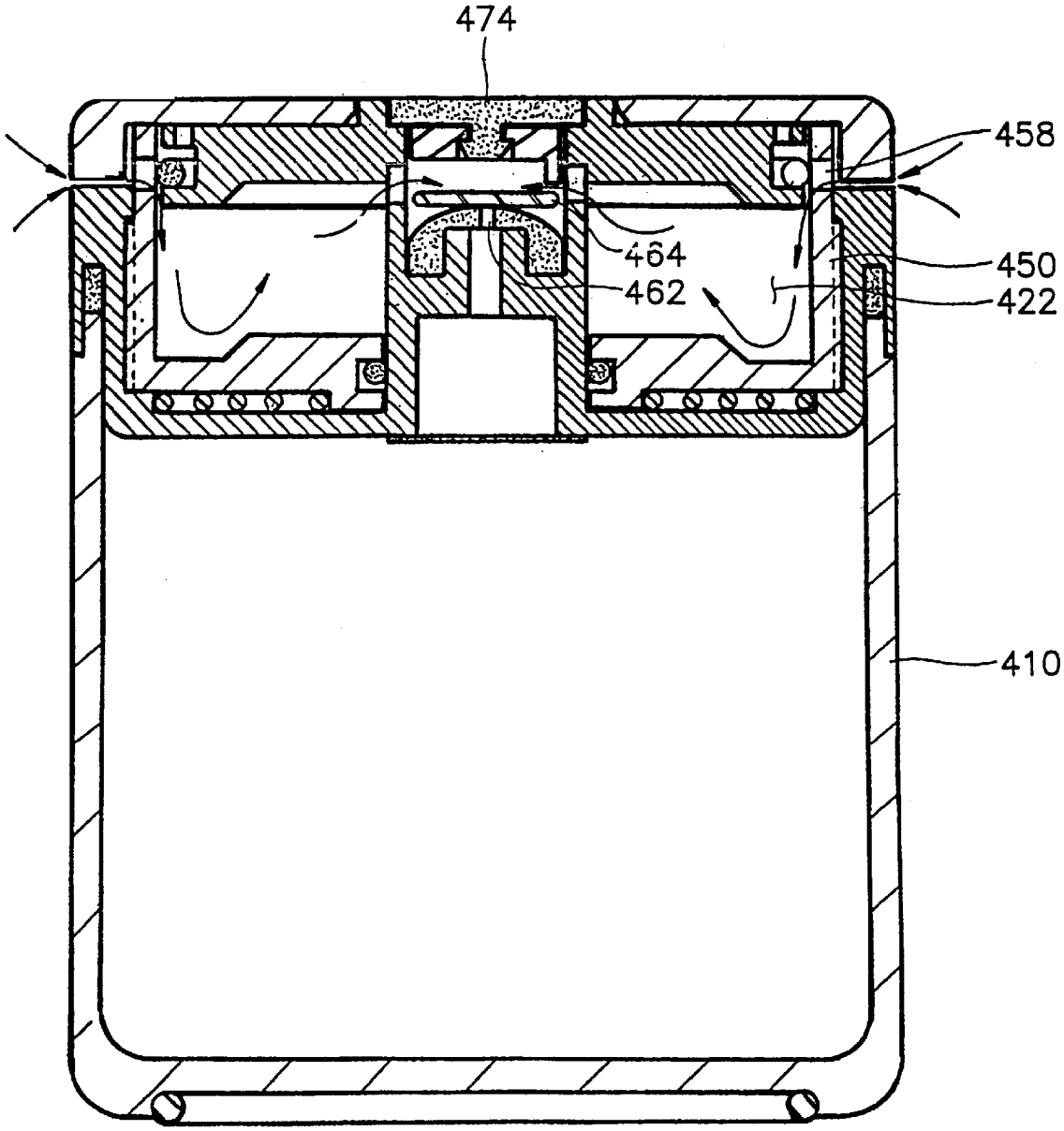
FIG. 17 is a partial sectional view of the vacuum bottle wherein the upper cylindrical member has reached its lowermost position.

When upper cylindrical member 450 descends to its lowermost position as shown in FIG. 17, fourth passage 458 makes upper space 422 communicate with the ambient, thereby drawing the outside air into upper space 422. Accordingly, at the underside of second disc member 474, the atmospheric pressure is applied again and second disc member 474 returns upward. Simultaneously, check valve 464 closes first passage 462 and maintains the vacuum state of bottle 410.

Figure 18:
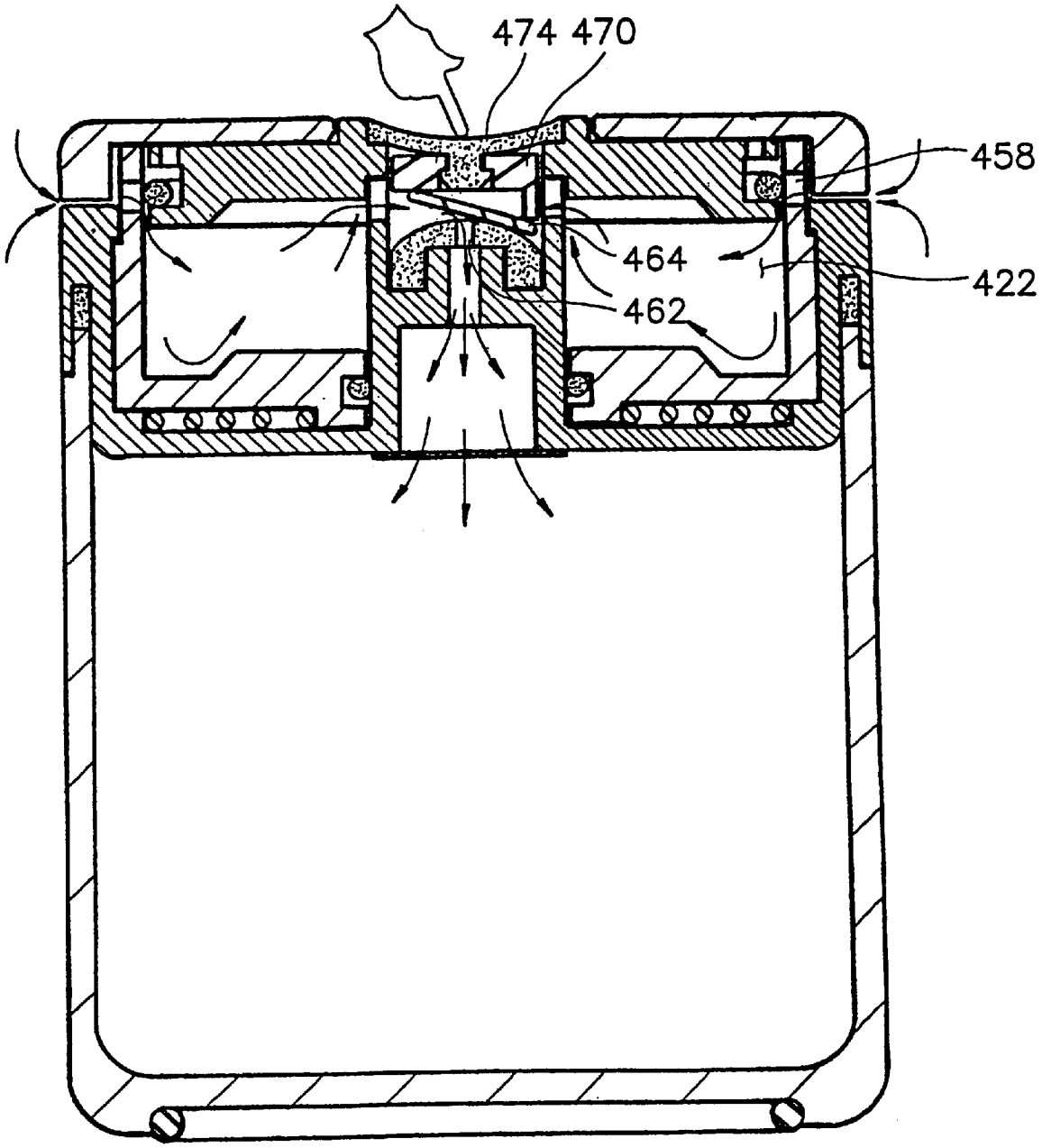
FIG. 18 is a partial sectional view which illustrates the release of vacuum in the bottle in accordance with the second preferred embodiment of the present invention.

To release the vacuum inside of bottle 410, a user must push down second disc member 474 manually as shown in FIG. 18. Then, check valve 464 pivots by operating member 470 and makes first passage 462 communicate with upper space 422 which in turn communicates with the ambient through fourth passage 458, thereby introducing the outside air into bottle 410.

As described above, the first and the second embodiments achieve a high vacuum easily inside of the space member such as a bottle, a medical evacuation instrument or the like by repetitive reciprocal operation and maintain a stable vacuum status.

Although the preferred embodiments of the invention have been described, it is understood that the present invention should not be limited to these preferred embodiments, but various changes and modifications can be made by one skilled in the art within the spirit and scope of the invention as hereinafter claimed.

What is claimed is:

1. A vacuum apparatus comprising:

a first means for forming a space portion in which a vacuum or an ambient pressure is applied, the first means being connected to a space member which encloses a predetermined space;

a second means for selectively forming a vacuum and ambient condition in the space portion, the second means being received a lower portion thereof into the first means for vertically reciprocating;

a third means for connecting or closing a passage between the space member and the space portion responding to a movement of the second means;

a fourth means for connecting or closing a passage between the space portion and ambient responding to the movement of the second means; and a fifth means for releasing a vacuum inside the space member, wherein the first means includes a lower cylindrical member with an upper portion thereof being opened and a first disc member mounted at an upper portion of the lower cylindrical member and defining an uppermost portion of the second means, the lower cylindrical portion being formed at a center thereof with a circular channel that extends upward from a lower portion of the lower cylindrical member, at a core portion of which a first passage communicating with the space member and ambient, at a circumferential portion of which a second passage is in fluid communication with the space member and the space portion, a first post that extends downward from the first disc member and having a predetermined clearance against the second passage, and a circular recess formed at an upper center portion of the first disc member.

2. The vacuum apparatus of claim 1, wherein the fifth means includes a second disc member for receipt into the circular recess, a second post extending downward from the second disc member and having a predetermined clearance against the first passage, a first O-ring press fitted between a lower end of the second post and the first passage, and a first compression spring positioned in the circular recess so as to urge upward the second disc member.

3. The vacuum apparatus of claim 2, wherein the first passage diverges downward.

4. The vacuum apparatus of claim 1, wherein the second means includes an upper cylindrical member with an upper portion thereof being opened, the upper cylindrical member being received a lower portion thereof into the lower cylindrical member so as to divide the space portion into upper and lower spaces, the second passage in fluid communication with the upper space.

5. The vacuum apparatus of claim 4, wherein the upper cylindrical member is formed at a lower wall thereof with an opening engaging with the circular channel, the opening being formed at a peripheral portion thereof with a first annular groove into which a second O-ring is inserted so as to block an airflow between the upper and lower spaces.

6. The vacuum apparatus of claim 4, wherein the third means includes a flexible check valve having a spherical portion at a center thereof, making contact with a lower end of the first post at the first disc member and selectively closing the second passage, the check valve being deformed upward at a circumferential portion thereof when a vacuum is formed in the upper space thereby opening the second passage, and being returned downward when ambient pressure is applied in the upper space thereby closing the second passage.

7. The vacuum apparatus of claim 4, wherein the first disc member is formed at a peripheral portion thereof with a second outward annular groove, the second annular groove is formed at an upper side location thereof with a third passage communicating with the ambient, and the fourth means includes a third O-ring inserted into the second annular groove, the third O-ring being smaller than the second annular groove in height, being slipped downward between an inner wall of the upper cylindrical member and a lower end of the second annular groove when the upper cylindrical member moves downward, thereby preventing an inflow of the ambient air into the upper space, and being slipped toward an upper end of the second annular groove when the upper cylindrical member moves upward, thereby connecting the upper space and the third passage.

8. The vacuum apparatus of claim 7, wherein the upper cylindrical member is formed at a side wall thereof with a fourth passage communicating with the ambient so as to communicate the upper space with the ambient when the lower wall of the upper cylindrical member makes contact with the lower wall of the lower cylindrical member.

9. The vacuum apparatus of claim 4, wherein a second compression spring is located between an underside of the upper cylindrical member and an upper surface of the lower cylindrical member, thereby upward urging the upper cylindrical member.

10. The vacuum apparatus of claim 4, wherein the upper cylindrical member is formed at the upper surface thereof with a first step portion and the first disc member is formed at an underside thereof with a second step portion engaging with the first step portion.

11. The vacuum apparatus of claim 4, further comprising a cover mounted to the upper portion of the upper cylindrical member for facilitating a user the vertical reciprocal movement of the upper cylindrical member.

12. The vacuum apparatus of claim 1, wherein a filter is provided at a lower end portion of the circular channel of the lower cylindrical member.

* * * * *